US006443028B1

(12) United States Patent
Brock

(10) Patent No.: US 6,443,028 B1
(45) Date of Patent: Sep. 3, 2002

(54) ADJUSTABLE CONTROL PEDAL ASSEMBLY FOR MOTOR VEHICLE

(75) Inventor: Thomas Arthur Brock, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 12 days.

(21) Appl. No.: 09/676,571

(22) Filed: Oct. 2, 2000

(51) Int. Cl.[7] ..... G05G 1/14
(52) U.S. Cl. ..... 74/512
(58) Field of Search ..... 74/512, 513, 560

(56) References Cited

U.S. PATENT DOCUMENTS

| | | | | | |
|---|---|---|---|---|---|
| 3,643,524 | A | | 2/1972 | Herring | 74/512 |
| 3,643,525 | A | | 2/1972 | Gibas | 74/512 |
| 3,691,868 | A | * | 9/1972 | Smith | 74/512 |
| 4,875,385 | A | | 10/1989 | Sitrin | 74/512 |
| 4,989,474 | A | | 2/1991 | Cicotte et al. | 74/512 |
| 5,010,782 | A | * | 4/1991 | Asano | 74/512 |
| 5,078,024 | A | | 1/1992 | Cicotte et al. | 74/512 |
| 5,351,573 | A | | 10/1994 | Cicotte | 74/512 |
| 5,460,061 | A | | 10/1995 | Redding et al. | 74/512 |
| 5,697,260 | A | | 12/1997 | Rixon et al. | 74/514 |
| 5,771,752 | A | | 6/1998 | Cicotte | 74/512 |
| 5,823,064 | A | | 10/1998 | Cicotte | 74/512 |
| 5,934,151 | A | | 8/1999 | Carr et al. | 74/512 |
| 5,964,125 | A | | 10/1999 | Rixon et al. | 74/514 |
| 5,996,438 | A | * | 12/1999 | Elton | 74/512 |
| 6,019,015 | A | * | 1/2000 | Elton | 74/513 |
| 6,151,984 | A | * | 11/2000 | Johannsson et al. | 74/512 |
| 6,173,625 | B1 | * | 1/2001 | McFarlane et al. | 74/512 |
| 6,301,993 | B1 | * | 10/2001 | Orr et al. | 74/512 |

* cited by examiner

*Primary Examiner*—David A. Bucci
*Assistant Examiner*—Justin Stefanon
(74) *Attorney, Agent, or Firm*—Laura C. Hargitt

(57) ABSTRACT

An adjustable control pedal assembly for a motor vehicle, presenting a compact arrangement of throttle control and brake pedals having a fixed spatial relationship throughout a range of adjustability. The pedals present a constant control set to the operator of the motor vehicle throughout the range of adjustability both in their separation distances, pedal face step-over relationship, and the attitude of the pedal faces with respect to the vehicle operator.

25 Claims, 6 Drawing Sheets

ADJUSTABLE CONTROL PEDAL ASSEMBLY FOR MOTOR VEHICLE

BACKGROUND OF THE INVENTION

1. Field of the Invention

The invention relates to control pedals for a motor vehicle. In one of its aspects, the invention relates to a control pedal assembly for a motor vehicle. In another of its aspects, the invention relates to adjustable control pedals. In another of its aspects, the invention relates to an adjustable control pedal assembly for a motor vehicle.

2. Description of the Related Art

In a motor vehicle, the control interface between the driver and the motor vehicle mechanisms for acceleration, braking, and a clutch, takes the form of foot-operated pedals located underneath the instrument panel in front of the driver. These foot-operated pedals are commonly mounted on a lever arm that is pivotally mounted to a fixed point in the vehicle and arranged to exert a compression or tensile force on a linkage with the respective mechanism, whether it be acceleration, braking, or clutch.

A given motor vehicle, however, might be operated by multiple drivers, potentially having different physical dimensions, such as leg length or foot size. This necessitates some adjustability in the motor vehicle to accommodate drivers of different sizes. The most common adjustability built into the automobile has been incorporating adjustability into the driver's seat, and to some extent to the steering wheel of the vehicle, to place the operator at the proper distance from the foot pedals and steering wheel. This has some limitations, however, as it is known to be undesirable to have an operator placed too close to the steering wheel, and there are practical limits to the adjustability of the driver's seat and/or steering wheel while still providing proper spacing from the otherwise positionally fixed foot pedals.

Efforts have been made to provide some adjustability to the control pedals of the motor vehicle, but such efforts have had limited commercial success. Prior art attempts to develop adjustability have resulted in a bulky construction, and have generally failed to take into consideration the functional relationship between the accelerator, brake and clutch, particularly the relative positioning of the pedals throughout the adjustment range, and the expectations of the operator as to that relative positioning. A uniform and optimum relationship between the pedals will aid the operator in efficient operation of the motor vehicle.

It would be advantageous to develop an adjustable system of control pedals, or a control pedal assembly, for a motor vehicle, wherein the control pedal assembly provides a compact, unified construction, and maintains a uniform relationship between the pedals independent of the position of the assembly throughout its range of adjustability.

SUMMARY OF THE INVENTION

The invention relates to a control pedal assembly for a motor vehicle, including a first pedal and a second pedal, a cradle for pivotal connection to the motor vehicle about a cradle pivot axis, and a pedal positioning assembly, wherein the pedals are pivotally connected to the cradle about a pedal pivot axis, and wherein the cradle is pivotable about the cradle pivot axis by the pedal positioning assembly throughout a range of adjustability. In a preferred embodiment, the pedal positioning assembly comprises a motor-driven ball screw threadably connected with a drive nut pivotally mounted to the cradle.

The pedal positioning assembly can further include a second motor-driven ball screw threadably connected with a second drive nut pivotally mounted to one of the pedals. Both ball screws can be driven by a single motor, and can have the same or differing thread pitches.

In one aspect of the invention, one of the ball screws is carried by a rotation socket operably connected to a brake push rod.

In another aspect of the invention, the first and second ball screws are configured to simultaneously adjust the position of the cradle and the pedals, whereby the first pedal maintains a fixed spatial relationship to the second pedal throughout the range of adjustability. The assembly is further configured to maintain the pedals in a constant attitude to an operator of the vehicle throughout the range of adjustability.

In another aspect of the invention, wherein the ball screw rotates in a rotation hub pivotally connected to the brake push rod, the connection between the rotation hub and the brake push rod is restricted to move in an arc by an idler arm pivotally connected at a first end to the vehicle and at a second end to the connection between the rotation hub and brake push rod.

In another aspect of the invention, the control pedal assembly for a motor vehicle comprises a cradle, an electronic throttle control, and a brake pedal, wherein the brake pedal is pivotally mounted to the cradle about a brake pedal pivot axis, the electronic throttle control includes a throttle control pedal and is connected to a bracket pivotally mounted to the cradle about the brake pedal pivot axis, and the cradle is pivotally mounted to the motor vehicle about a cradle pivot axis, the control pedal assembly further comprising a pedal positioning assembly for adjustably positioning the pedals within a range of adjustability. The assembly further includes a guide pin configured to ride in a guide pin slot for maintaining the throttle control pedal at a constant attitude to the vehicle operator.

In another aspect of the invention, an adjustable control pedal for a motor vehicle comprises an arm-mounted pedal operably connected to a vehicle control apparatus and pivotally connected to a support structure that is pivotally connected to the motor vehicle, the support structure including a positioning assembly for positioning the control pedal at a constant attitude, relative to an operator of the vehicle, within a range of adjustability. The control apparatus can include a vehicle throttle control system or vehicle brake system.

DESCRIPTION OF THE PREFERRED EMBODIMENT

Figure 1:
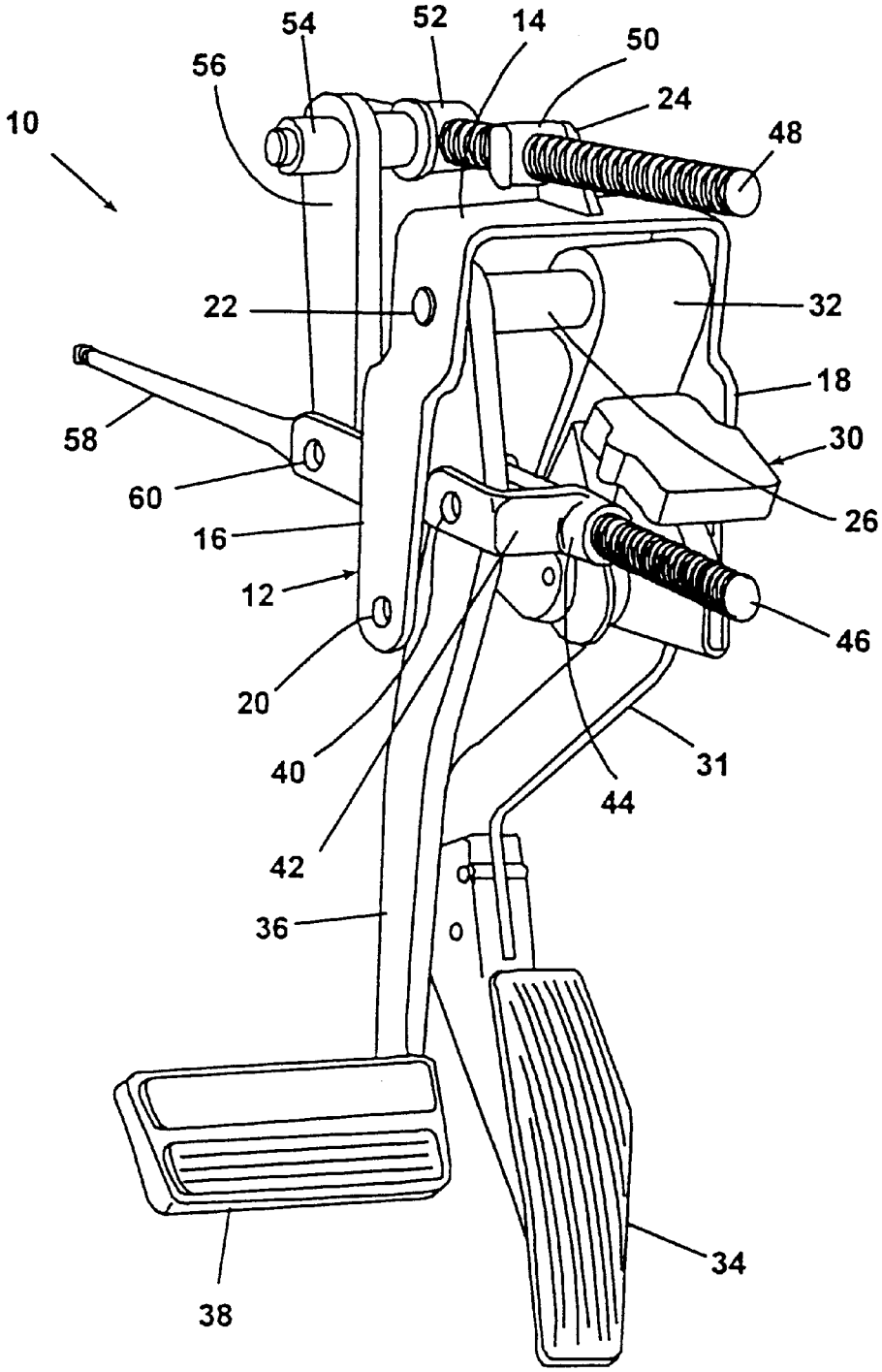
FIG. 1 is a left side perspective view of an adjustable control pedal assembly for a motor vehicle according to the invention.
Figure 2:
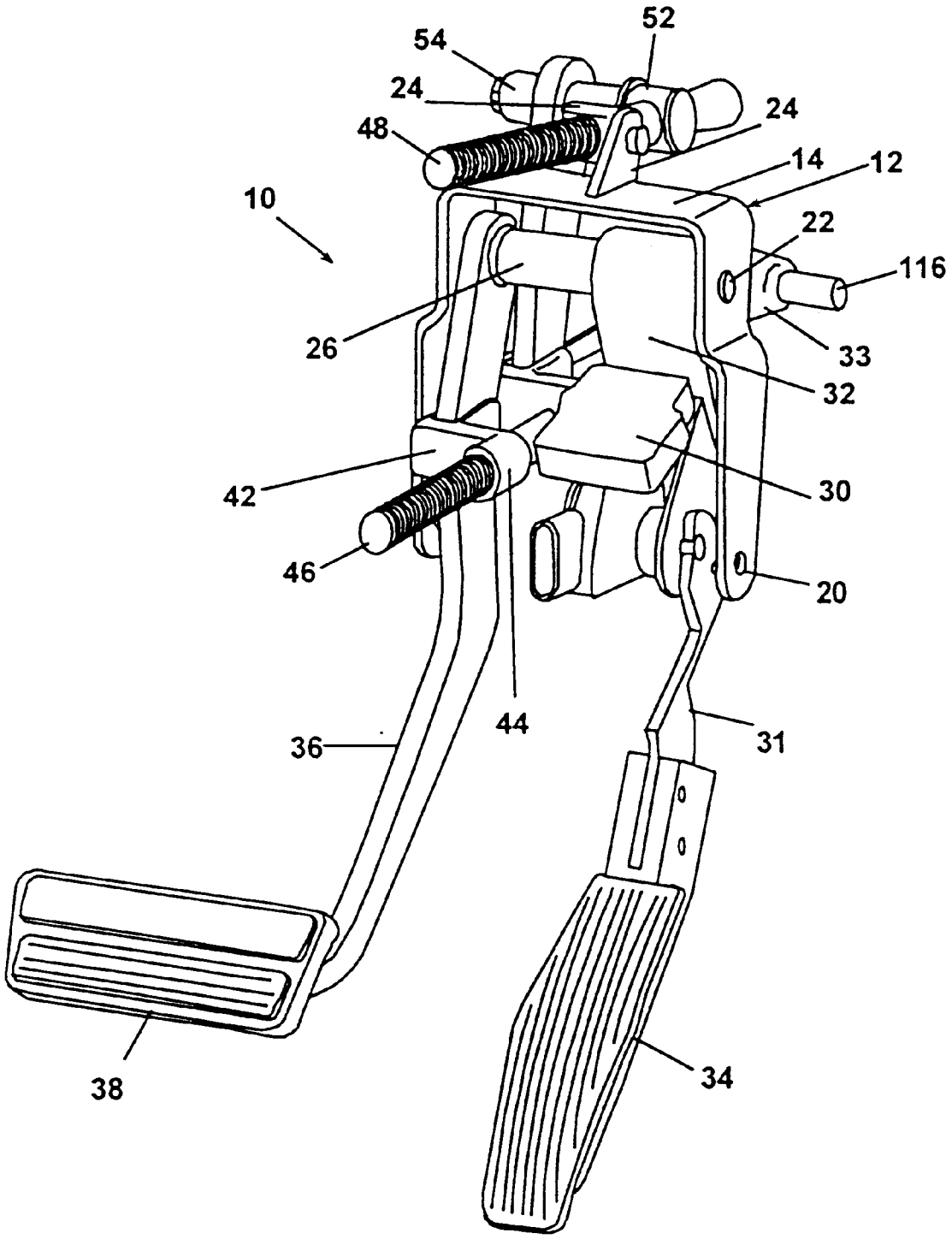
FIG. 2 is a right side perspective view of the assembly of FIG. 1.

Referring to the figures, and with particular reference to FIG. 1, the pedal assembly 10 according to the invention comprises a cradle 12 in the form of an inverted "U" having a top strap 14 and two depending arms 16, 18. Cradle arms 16, 18 are substantially mirror images of one another. Cradle pivot pin openings 20 pass through the lower end of each cradle arm 16, 18, each aligned with the other; likewise, brake arm pivot pin openings 22 pass through an upper portion of each cradle arm 16, 18. Brake arm pivot pin 26 is received in brake arm pivot pin openings 22. An upstanding cradle nut mounting ear 24 extends from cradle top strap 14.

Pedal assembly 10 further comprises an electronic throttle control (hereinafter ETC) 30 mounted to an ETC mounting bracket 32 pivotally received on brake arm pivot pin 26. ETC 30 is a rheostat-type switch for generating the control signal for an engine throttling system, as such as electronic fuel injection, the function of which is beyond the scope of this disclosure, but is well known to those of ordinary skill in the art. ETC 30 further comprises a throttle arm 31 pivotally mounted at one end to ETC 30 and comprising a throttle pedal 34 at an opposing end for foot control by a vehicle operator. A brake arm 36 is pivotally connected at a first end to brake arm pivot pin 26, and further comprises a brake pedal pad 38 at an opposing end for foot control of a vehicle's brakes by the vehicle operator. Brake arm 36 further comprises a brake arm nut pivot opening 40 for pivotally receiving brake arm nut 42. Brake arm nut 42 comprises an internally threaded portion 44.

Figure 3:
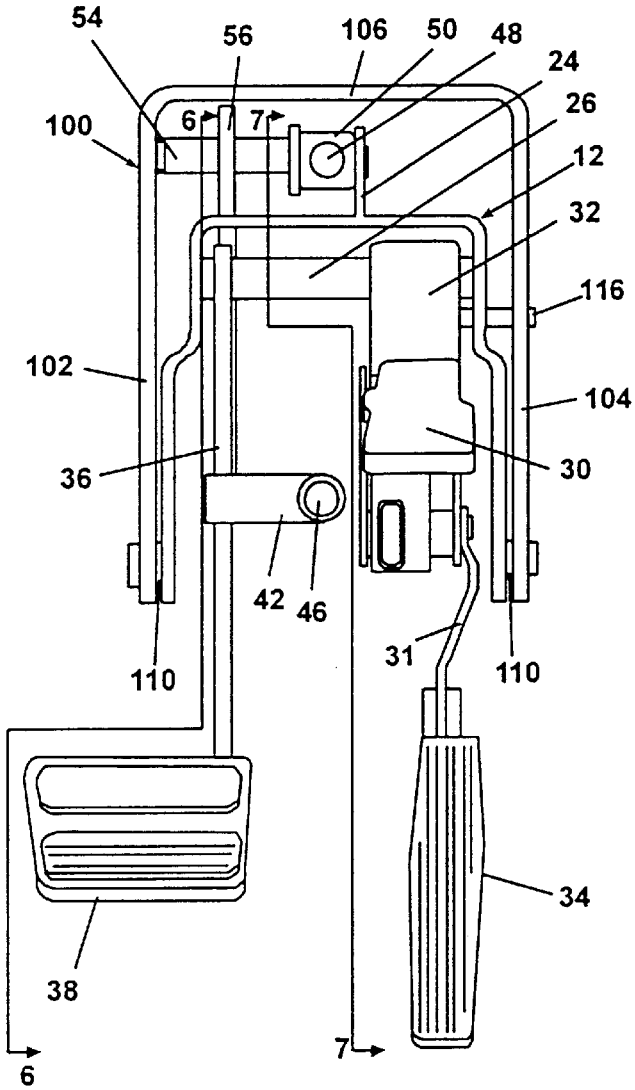
FIG. 3 is a front elevation of the adjustable control pedal assembly of FIGS. 1 and 2.
Figure 4:
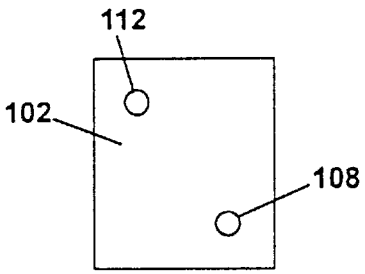
FIG. 4 is a partial side view of a support bracket for the adjustable control pedal assembly of FIGS. 1–3.
Figure 5:
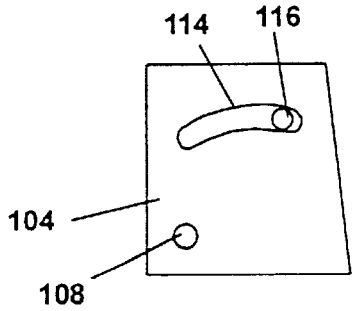
FIG. 5 is a partial opposite side view of the support bracket for the adjustable control pedal assembly of FIGS. 1–3

Pedal assembly 10 further comprises a pedal positioning assembly for adjustably positioning the pedals 34, 38 throughout a range of adjustability. The pedal positioning assembly includes at least two controllable linear displacement mechanisms, one for each of the pedals 34, 38. The linear displacement mechanisms can take the form of a worm drive, servo-motor, or other mechanism well-known to those skilled in the art. In the preferred embodiment depicted, a first ball screw 48 is threadably received in cradle nut 50, which is pivotally attached to ear 24. First ball screw hub 52 rotatably receives first ball screw 48, and is rotatably attached to pedal assembly support bracket 100 (see FIG. 3) by idler arm pivot pin 54. Idler arm 56 is pivotally attached to idler arm pivot pin 54 at a first end and is pivotally attached to brake booster push rod 58 at a second end by push rod pivot pin 60.

Referring now to FIGS. 2–5, support bracket 100 includes two depending side walls 102, 104 fixedly connected by a top wall 106. Side walls 102, 104 each include a cradle pivot pin opening 108. Each of the cradle pivot pin openings 108 aligns to correspond with the cradle pivot pin openings 20 of the cradle 12, for pivotal connection of the cradle 12 to the side walls 102, 104 by a pair of cradle pivot pins 110. Side wall 102 further comprises an idler arm pivot opening 112 for receiving idler arm pivot pin 54. Side wall 104 further comprises a slot 114 for slidably receiving an ETC bracket guide pin 116. Guide pin 116 extends perpendicularly through side wall 104 from a tail portion 33 of ETC bracket 32.

Figure 6:
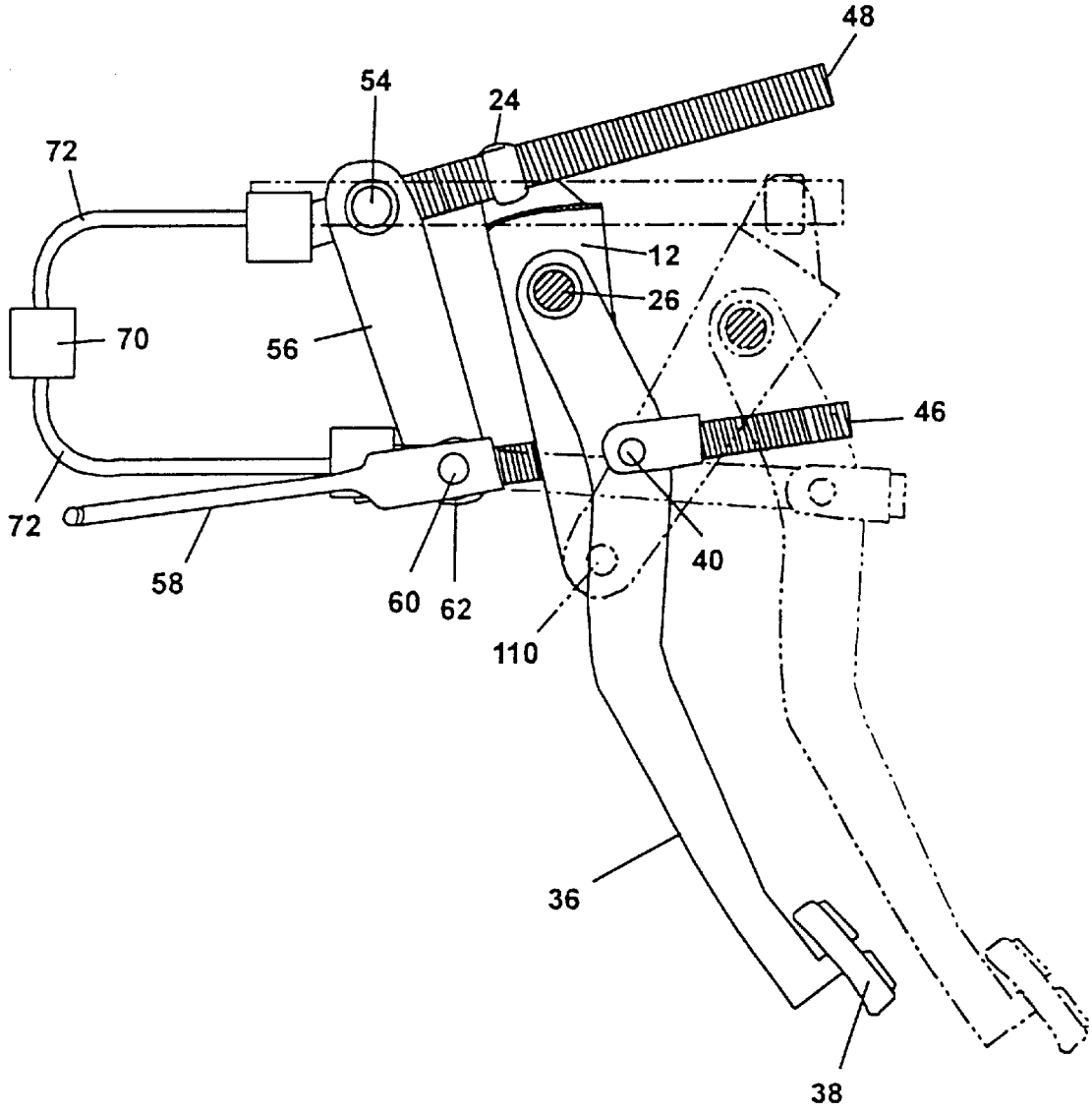
FIG. 6 is a partial cross-sectional view taken through line 6—6 of FIG. 3 showing only the brake pedal in two adjusted positions.

Referring now to FIG. 6, second ball screw 46 is rotatably received in a second ball screw hub 62 pivotally attached to push rod pivot pin 60 at lower end of idler arm 56. Second ball screw 46 is threadably received in threaded portion 44 of brake nut 42.

In a static position, it can be seen that the pedal assembly 10 is fixed in position with respect to support bracket 100 in that while cradle 12 is pivotally mounted to support bracket 100 at cradle pivot pins 110, the upper end of cradle 12 is fixed in place by first ball screw 48 threadably received in cradle nut 50, first ball screw 48 being restricted from longitudinal movement, its rotational hub 52, being positionally fixed with respect to support bracket 100 by idler arm pivot pin 54. Pedal assembly 10 is therefore positionally anchored to support bracket 100 at cradle pivot pins 110 and idler arm pivot pin 54. Cradle 12 is further rotationally fixed with respect to support bracket 100, so long as first ball screw 48 is longitudinally fixed at hub 52 and threadably received in cradle nut 50 which is pivotally attached to ear 24.

It can further be seen that brake pedal arm 36 has a fixed position relative to idler arm 56, so long as second ball screw 46 is threadably received in brake nut 44 and rotatably received in second ball screw hub 62, each of which are pivotally attached to brake arm 36 and idler arm 56, respectively. Application of force to brake pedal pad 38 will necessarily transfer force to brake booster push rod 58 through brake nut 44, second ball screw 46, second ball screw hub 62, and push rod pivot pin 60. Brake booster push rod 58 is mechanically linked to the motor vehicle's brake system (not shown). Brake booster rod 58 receive a uniformly directed braking force at push rod pivot pin 60, regardless of the position of brake arm 36, as pivot pin 60 can only rotate in the arc defined by idler arm 56 about idler arm pivot pin 54.

Figure 7:
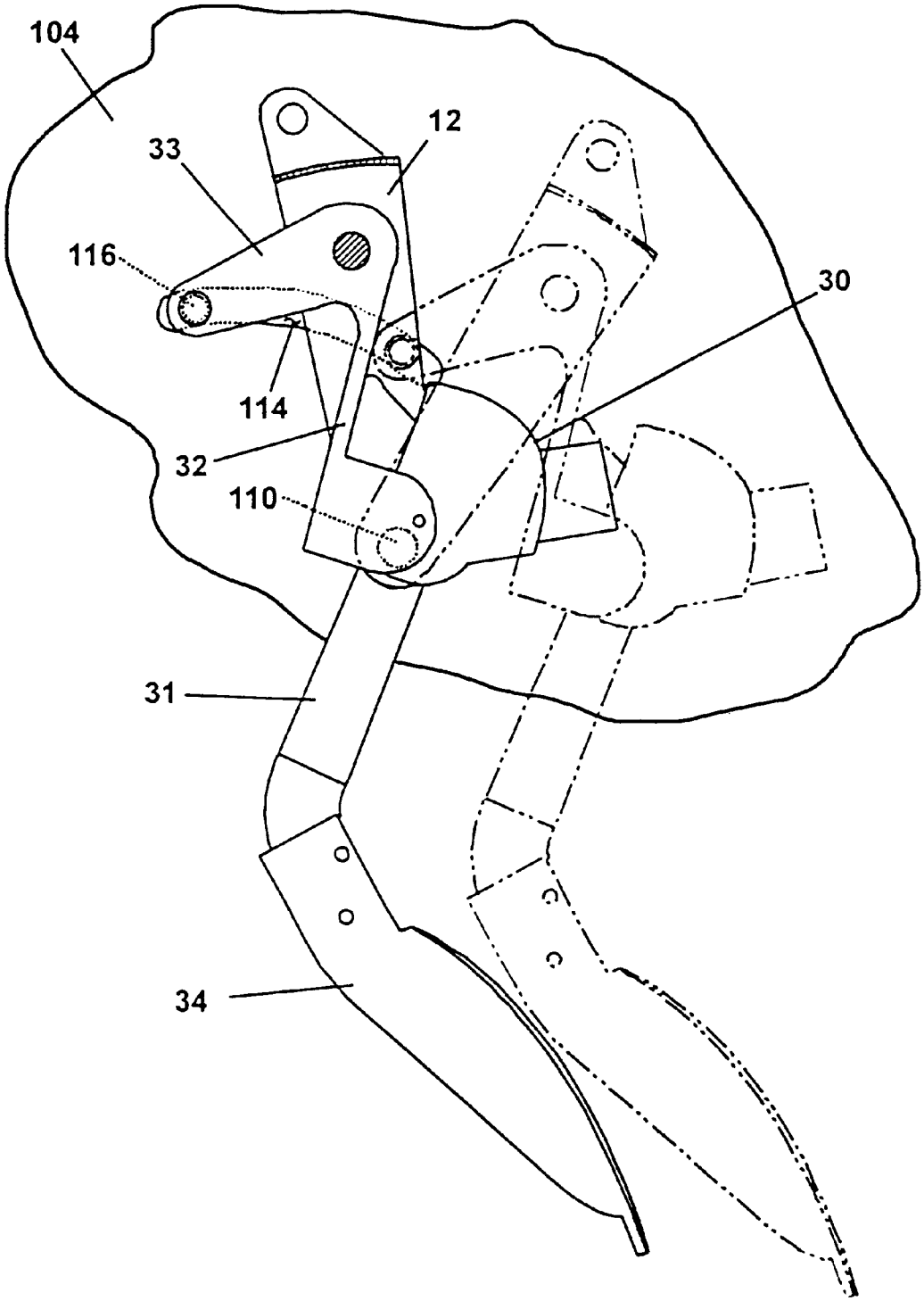
FIG. 7 is a partial cross-sectional view taken through line 7—7 of FIG. 3 showing only a throttle pedal in two adjusted positions.

Each of the ball screws 46, 48 is operably connected to an electrically operated and controlled motor 70, such as by cables 72, motor 70 and cable 72 operating to rotate ball screws 46, 48 in a controlled and coordinated fashion. Referring to FIGS. 6 and 7, brake arm 36 and throttle arm 31 are adjustable throughout the range of adjustability, with a first position illustrated, and a second position shown in phantom. As first ball screw 48 rotates, cradle nut 50, being threadably received on first ball screw 48, travels longitudinally along first ball screw 48, causing cradle 12 to pivot about cradle pivot pins 110 as ear 24 and top strap 14 of cradle 12 travel longitudinally along first ball screw 48. As cradle nut 50 travels along first ball screw 48, it pivots with respect to ear 24 to prevent any binding of ball screw 48 in nut 50 as cradle 12 describes an arc about cradle pivot pins 110. As cradle 12 pivots about cradle pivot pins 110, brake arm pivot pin 26 describes an arc about cradle pivot pins 110. In traversing this arc, brake arm pivot pin 26 moves the pivot point of the brake arm 36 and the upper end of the ETC mounting bracket 32. It is clearly necessary to provide a structure to control the movement of the ETC mounting bracket 32 and the brake arm 36 to keep the pedals 34, 38 in position for operation by a vehicle operator. For instance, if the brake nut pivot point 40 were maintained in a constant position as brake arm pivot pin 26 were rotated about cradle pivot pins 110, brake pedal 38 would be rotated about brake nut pivot pin 40 in a direction opposite to the movement of cradle nut 50 along first ball screw 48. The same result would occur with pedal 34 if the ETC mounting bracket 32 were fixed to cradle 12.

To keep brake arm 36 in a uniform relationship to the vehicle operator, second ball screw 46 is rotated in consonance with first ball screw 48 so as to displace brake nut 44 longitudinally along second ball screw 46 a complementary distance with respect to the travel of brake arm pivot pin 26, to keep brake pedal 38 at a uniform attitude. This can be accomplished in one of a number of manners, such as strategically placing brake nut pivot pin 40 on brake arm 36, relative to the positions of cradle nut 50 and brake arm pivot pin 26, or can be further adapted by a strategic selection of the thread pitch of first ball screw 48 and second ball screw 46, these methods using a common rotational speed for first and second ball screws 46, 48. In the alternative, first and second ball screws 46, 48 can be driven at different rotational speeds, such as by gearing between motor 70 and cables 72.

In like fashion, ETC bracket 32 is maintained in a constant relationship with the vehicle operator and with respect to brake arm 36. ETC bracket 32 shares a common pivot point in brake arm pivot pin 26, with brake arm 36 as cradle 12 rotates about cradle pivot pins 110. Brake arm pivot pin 26 travels in an arcuate path, carrying ETC bracket 32 with it. ETC bracket guide pin 116, projecting transversely from rear portion 33 of ETC bracket 32, rides in guide pin slot 114 of support bracket 100. The guide pin slot is so arranged that as cradle 12 rotates about cradle pivot pin 110, and guide pin 116 rides in guide pin slot 114, ETC bracket 32 is kept at a constant attitude with respect to the vehicle operator.

Figure 8:
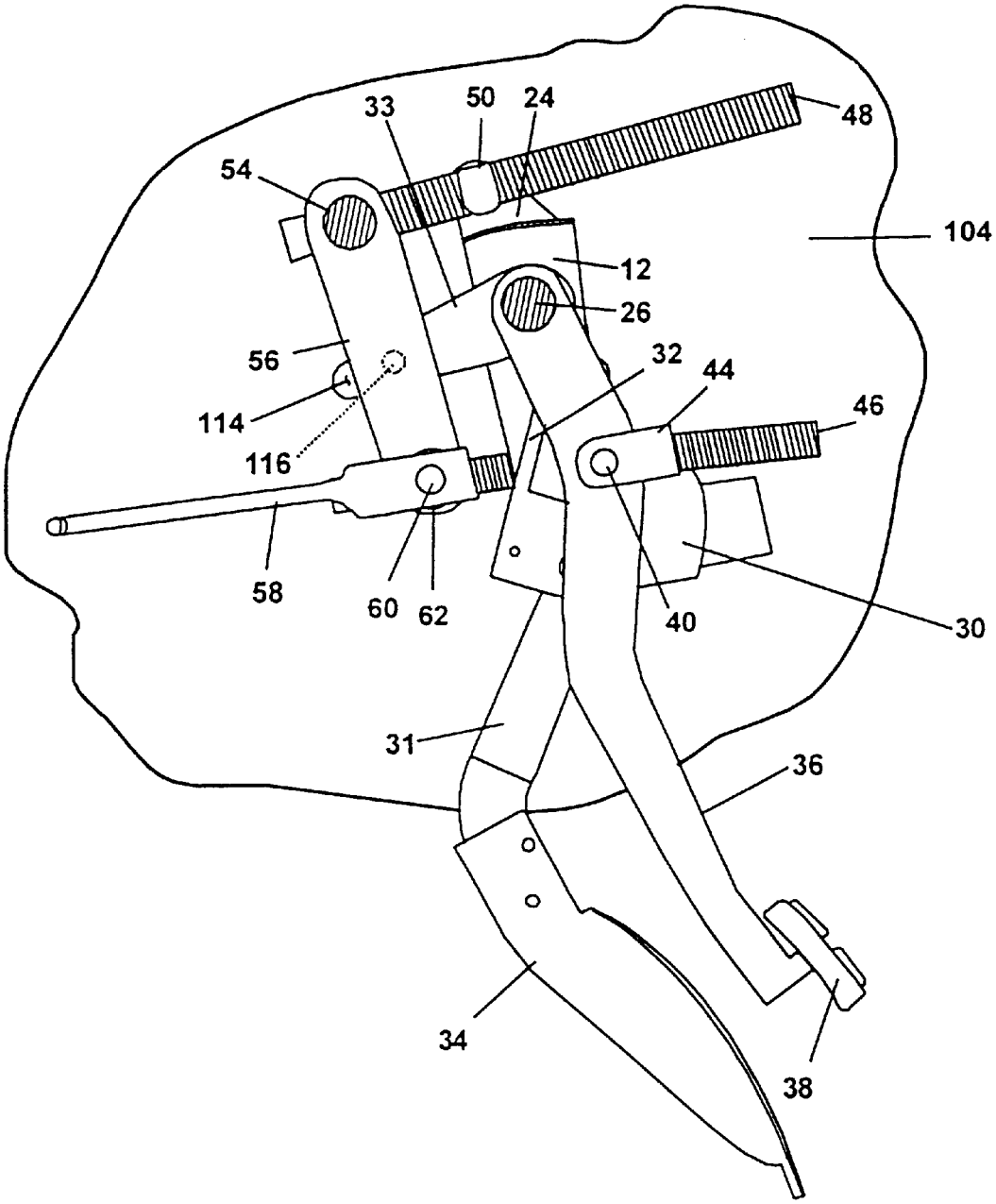
FIG. 8 is a partial cross-sectional view as in FIG. 6 showing both pedals in a first adjusted position.

Throttle pedal 34 and brake pedal 38 are therefore both maintained in a constant attitude with respect to the vehicle operator, and, having a common anchor point in brake arm pivot pin 26, pedals 34, 38 are also therefore maintained in a uniform relationship with one another, as shown in FIG. 8. The pedals 34, 38 can therefore be placed in an optimal operating relationship for safety and efficiency, and the vehicle operator can operate the foot controls in confidence, knowing that the foot controls will be at a constant attitude with respect to the operator, and the foot controls will have the same relationship to each other, throughout their adjustment range.

While the invention has been specifically described in connection with certain specific embodiments thereof, it is to be understood that this is by way of illustration and not of limitation, and the scope of the appended claims should be construed as broadly as the prior art will permit.

What is claimed is:

1. A control pedal assembly for a motor vehicle, comprising:

a first pedal, a second pedal, a cradle for pivotally connecting the first and second pedals to the motor vehicle, and a pedal positioning assembly including, a first controllable linear displacement mechanism pivotally mounted to the cradle and a second controllable linear displacement mechanism pivotally mounted to one of the first pedal and the second pedal, wherein consonant movement of the first and second linear displacement mechanisms results in movement of the first and second pedals such that they maintain a uniform attitude.

2. The assembly of claim 1, wherein the first controllable linear displacement mechanism comprises a first motor-driven ball screw threadably connected with a drive nut pivotally mounted to the cradle.

3. The assembly of claim 1, herein the second controllable linear displacement mechanism comprises a second motor-driven ball screw threadably connected with a second drive nut pivotally mounted to one of the first pedal and the second pedal.

4. The assembly of claim 1, wherein the first and second ball screws are driven by a single motor.

5. The assembly of claim 4, wherein the first and second ball screws have different thread pitches.

6. The assembly of claim 4, wherein the first and second ball screws have the same thread pitch.

7. The assembly of claim 1, wherein the second ball screw further comprises a rotation socket operably connected to a brake push rod.

8. The assembly of claim 7, wherein the rotation socket is pivotally connected to the brake push rod.

9. The assembly of claim 1, wherein the first and second ball screws are configured to simultaneously position the cradle and the one of the first and second pedals, whereby the first pedal maintains a fixed spatial relationship to the second pedal throughout the range of adjustability.

10. The assembly of claim 1, wherein the first pedal is operably connected to a throttle control, and the throttle control is an electronic throttle control pivotally connected to the cradle at the pedal pivot axis.

11. The assembly of claim 1, wherein the first pedal is configured to be in a fixed spatial relationship to the second pedal throughout the range of adjustability.

12. The assembly of claim 1, wherein the first pedal is configured to maintain a constant attitude to an operator of the vehicle throughout the range of adjustability.

13. The assembly of claim 9, wherein the second pedal is a brake pedal adapted to be operably and adjustably connected to a brake push rod.

14. The assembly of claim 13, wherein a ball screw rotates in a rotation hub pivotally connected to the brake push rod, and wherein the rotation hub and brake push rod are restricted to move in an arc by an idler arm adapted to be pivotally connected at a first end to the vehicle and at a second end to the rotation hub and brake push rod.

15. A control pedal assembly for a motor vehicle comprising:

a cradle, wherein the cradle is adapted to be pivotally mounted to the motor vehicle about a cradle pivot axis, a brake pedal, wherein the brake pedal is pivotally mounted to the cradle about a brake pedal pivot axis, an electronic throttle control, wherein the electronic throttle control includes a throttle control pedal and is connected to a bracket pivotally mounted to the cradle about the brake pedal pivot axis, and a pedal positioning assembly for adjustably positioning the pedals within a range of adjustability, wherein the pedal positioning assembly comprises a first controllable linear displacement mechanism pivotally mounted to the cradle and a second controllable linear displacement mechanism pivotally mounted to one of the brake pedal and the throttle control pedal, and wherein the cradle is pivotable about the cradle pivot axis by the first controllable linear displacement mechanism throughout a range of adjustability.

16. The assembly of claim 15, wherein the pedal positioning assembly is configured to adjustably position the cradle about the cradle pivot axis.

17. The assembly of claim 16, wherein the throttle control pedal is arranged with a fixed spatial relationship to the brake pedal.

18. The assembly of claim 17, wherein the pedal positioning assembly is configured to maintain the spatial relationship of the throttle control pedal and the brake pedal throughout the range of adjustability.

19. The assembly of claim 18, wherein the assembly includes a guide pin configured to ride in a guide pin slot for maintaining the throttle control pedal at a constant attitude.

20. The assembly of claim 15, wherein the pedal positioning assembly is further configured to adjustably position the brake pedal relative to a brake booster push rod.

21. The assembly of claim 20, wherein the brake pedal maintains a constant attitude to an operator of the motor vehicle throughout the range of adjustability.

22. The assembly of claim 21, wherein the pedal positioning assembly is configured to maintain the spatial relationship of the throttle control pedal and the brake pedal throughout the range of adjustability.

23. The assembly of claim 22, wherein the throttle control pedal presents a constant attitude to an operator of the motor vehicle throughout the range of adjustability.

24. The assembly of claim 23, wherein the assembly includes a guide pin configured to ride in a guide pin slot for maintaining the throttle control pedal at the constant attitude.

25. The assembly of claim 15, wherein the pedal positioning assembly is configured to maintain the spatial relationship of the throttle control pedal and the brake pedal throughout the range of adjustability.

* * * * *